US009610488B2

(12) United States Patent
Clisson

(10) Patent No.: US 9,610,488 B2
(45) Date of Patent: Apr. 4, 2017

(54) BREATHING AID ATTACHMENT FOR SWIMMER, SWIMMING DEVICE, GOGGLES AND MASK, GOGGLE SEAL

(71) Applicant: EPTEO, Nanterre (FR)

(72) Inventor: Laurent Clisson, Fresnes (FR)

(73) Assignee: EPTEO, Nanterre (FR)

( * ) Notice: Subject to any disclaimer, the term of this patent is extended or adjusted under 35 U.S.C. 154(b) by 200 days.

(21) Appl. No.: 14/378,070

(22) PCT Filed: Feb. 8, 2013

(86) PCT No.: PCT/FR2013/050274

§ 371 (c)(1),
(2) Date: Aug. 11, 2014

(87) PCT Pub. No.: WO2013/117875

PCT Pub. Date: Aug. 15, 2013

(65) Prior Publication Data

US 2015/0017621 A1 Jan. 15, 2015

(30) Foreign Application Priority Data

Feb. 10, 2012 (FR) ..... 12 51270

(51) Int. Cl.
*A63B 69/12* (2006.01)
*A63B 33/00* (2006.01)
*A63B 69/14* (2006.01)

(52) U.S. Cl.
CPC ..... *A63B 69/12* (2013.01); *A63B 33/00* (2013.01); *A63B 69/14* (2013.01); *A63B 2033/004* (2013.01)

(58) Field of Classification Search
USPC ..... 434/247, 254; 2/68, 426, 428, 429, 440, 2/445, 446, 448, 452
See application file for complete search history.

(56) References Cited

U.S. PATENT DOCUMENTS 2,705,802 A * 4/1955 Tellier ..... A42B 1/12 2/10
RE26,148 E * 1/1967 Wayfield ..... A63B 69/12 434/254
4,279,039 A * 7/1981 Drew ..... A42B 1/12 2/428
5,560,047 A 10/1996 Shimada
(Continued)

FOREIGN PATENT DOCUMENTS

FR 2 752 305 2/1998
JP 60-049863 4/1985

OTHER PUBLICATIONS

International Search Report issued for International Application No. PCT/FR2013/050274, dated Apr. 25, 2013.
(Continued)

*Primary Examiner* — Kurt Fernstrom
(74) *Attorney, Agent, or Firm* — Pillsbury Winthrop Shaw Pittman LLP

(57) ABSTRACT

A breathing aid attachment for swimming includes at least one first part for fixing the device to the head of a swimmer and a second part including a first substantially planar surface defined between a first edge and a second edge, the edges extending in a direction substantially perpendicular to the transverse plane of the human body.

25 Claims, 8 Drawing Sheets

(56) References Cited

U.S. PATENT DOCUMENTS

| | | | | |
|---|---|---|---|---|
| 5,685,723 | A * | 11/1997 | Ladin | A63B 69/12 368/10 |
| 5,813,056 | A * | 9/1998 | Ambrose | A63B 33/002 2/428 |
| 6,033,228 | A * | 3/2000 | Ladin | A63B 33/002 368/10 |
| 6,955,542 | B2 * | 10/2005 | Roncalez | A63B 24/0003 434/247 |
| 8,272,071 | B2 * | 9/2012 | Kaiser | A61F 9/04 2/15 |
| 2008/0268410 | A1 * | 10/2008 | Pemberton | G09B 19/00 434/254 |
| 2012/0122064 | A1 * | 5/2012 | Ben-Tal | A63B 24/0062 434/254 |
| 2014/0115762 | A1 * | 5/2014 | Kaiser | A63B 33/002 2/440 |
| 2014/0315171 | A1 * | 10/2014 | Tsai | A63B 69/10 434/254 |

OTHER PUBLICATIONS

Search Report and Written Opinion issued for French Patent Application No. 1251270, dated Oct. 22, 2012.

* cited by examiner

BREATHING AID ATTACHMENT FOR SWIMMER, SWIMMING DEVICE, GOGGLES AND MASK, GOGGLE SEAL

CROSS REFERENCE TO RELATED APPLICATIONS

This application is the U.S. National Stage of PCT/FR2013/050274, filed Feb. 8, 2013, which in turn claims priority to French Patent Application No. 1251270 filed Feb. 10, 2012, the entire contents of all applications are incorporated herein by reference in their entireties.

FIELD

The field of the invention relates to breathing aid devices for swimming. In particular the invention relates to equipment which may be fastened to the head of a swimmer and which allows the swimmer's breathing and performance to be improved.

STATE OF THE PRIOR ART

Breathing is an essential element of swimming efficiency, in particular for the swimming stroke known as "crawl".

There are currently known devices which allow swimming whilst keeping the head submerged under water. For example, the snorkel is a breathing aid attachment for leisure swimming, which is particularly suitable for diving or snorkelling activities. This attachment is, however, incompatible with a good swimming position when a degree of speed of execution is sought, in particular for swimming strokes of the crawl type. The snorkel is generally reserved for conventional swimming strokes for purposes of exploration or leisure.

Besides, the snorkel is not intended to solve the set of problems associated with learning the crawl and in particular with regulation of breathing and the various steps that a swimmer must carry out in order to perform this swimming stroke.

From the first stages in learning, starters must learn to exhale deeply in the water in order to then be able to perform an effective, short inhalation out of the water.

No means exist which can be used to help and optimise a swimmer's breathing with the aim of learning to breath whilst reducing the swimmer's effort and improving speed performance.

Swimmers, particularly when learning the crawl, must follow various steps in order to ensure a breathing rhythm is achieved whilst swimming.

One first step involves taking in air. Opening the mouth allows the swimmer to inhale a volume of air over a certain length of time. Inhalation is generally carried out when the head is directed to one side, whilst opening the mouth and inhaling.

One second step is a transition step which allows the head to be brought towards the direction of swimming so that the top of the head is aligned in the direction of swimming, the eyes downwards, into the depth of the water, for example towards the bottom of a pool.

A third step comprises exhalation of the air underwater, this step being ideally carried out in a uniform manner, with a continuous effort being made.

A fourth step is also a transition step which comprises a movement of the head towards one side in order to return to the first inhalation step.

The crawl is a difficult swimming stroke which demands years of training. Even when practised by the best swimmers, there is a constant search to optimise this stroke and achieve the best possible efficiency of the four steps described above.

It is difficult for swimmers not to be distracted and slowed down by the inevitable pitching motion of the head during the second and fourth steps. Since the head movements are perpendicular to the direction of swimming, they must be optimised so that movement is "just sufficient", that is, by limiting the amplitude of the head rotation movements.

The air inhalation step must be as brief as possible whilst ensuring that a sufficient volume of air is inhaled. There is therefore an optimum compromise for carrying out the air inhalation step, with the aim of performing the best possible exhalation step in mind. The duration of the latter may vary depending on the rhythm of the stroke. Swimmers may inhale air every other time, every fourth time or at even longer intervals, of every eight times, for example.

With this aim, swimmers often carry out a rotation movement of the head which is greater than that required to bring the mouth above the level of the water. Time can be lost and a slowing down may be observed during this step. Limiting the time spent with the head out of the water reduces the negative consequences of this position on swimmers' balance and buoyancy. One drawback is that the slowing down caused by poor breathing and inappropriate movements may cause legs to submerge, which then sink and affect the ease of movement. There is therefore a "snowball" effect with consequences which adversely affect the stroke, buoyancy and the speed of swimmers.

Finally, during the exhalation step, swimmers may experience difficulties in achieving an orientation of their faces suitable for optimising their speed, and above all for maintaining a constant exhalation over time.

Breathing is particularly difficult to optimise when performing the crawl since the four steps require long and difficult practice.

For example, an inadequate breathing technique can cause scissoring movements of the feet, sideways compensation movement or a sinusoidal trajectory. Imperfections in propulsive movements may have their origin in breathing technique.

Finally, breathing and its optimisation meet a number of criteria which make a contribution towards improving swimmers' performance. In particular these criteria include:

- efficient breathing to allow swimmers to achieve the best possible oxygenation;
- rhythmic breathing in order to maintain the best possible buoyancy;
- breathing which is synchronised with propulsive movement in order not to reduce swimmers' speed,

SUMMARY OF THE INVENTION

The invention allows the aforementioned drawbacks to be resolved.

The subject of the invention is a breathing aid attachment for swimming. It comprises at least one first part comprising means for fixing the attachment and a second part comprising a first substantially planar surface. The first part is intended to hold a first zone of the first surface of the second part in contact with the skin of the swimmer's face so as to create a sensory indicator generated by differences in pressure applied to the first zone.

The means of fixing may also allow the attachment to be fixed directly to the head of a swimmer or onto swimming goggles, themselves intended to be fixed to the head of a swimmer.

Advantageously, the differences in pressure may be generated by a change in the position of the head of the swimmer, a change in the movement of the head of the swimmer or a change of the surroundings of the device between aquatic surroundings and air surroundings.

One advantage of this solution is to allow an attachment to be is obtained which is fixed to the face of a swimmer close to the mouth, so as to provide swimmers with an indication of whether their mouths are in a submerged or non-submerged position. This advantage allows swimmers to know, by sensing the difference in pressures applied to their skin, whether they can breathe or not. The position of the water in relation to the mouth is therefore estimated instinctively by swimmers by an effect of muscular memorisation of the pressure applied near to the mouth. Moreover, swimmers save energy by turning their heads with "just enough" force to allow them to breath, and therefore limit the amplitude of rotation of the head.

Advantageously the first surface comprises a first edge which is designed, when the device is fixed to the head of a swimmer, to extend along a direction which forms an angle of less than 60° with the normal to the transverse plane (where the plane is normalised in relation to the anatomy of the human body). One part at least of said edge is within the first zone.

In a nominal position of the body and the face, when the attachment of the invention is fixed to the head of a swimmer, the first edge is designed to be substantially perpendicular to the transverse plane.

Moreover, the subject of the invention relates to an attachment which has an edge delimiting the first surface and whose length is between 2 and 20 cm. A value of the length of between 4 and 15 cm is an optimum target value for both child and adult profiles.

Advantageously the second part of the attachment comprises a second surface joined to the first surface by at least one part of the first edge, with the first and the second surfaces forming an angle of between 90° and 180° at least one point at their junction. In another embodiment, the first and second surfaces form an angle of between 90° and 180° at any point of the junction.

Advantageously, the first part is fixed onto the head of a swimmer, and it allows the first surface of the second part to be held against the face of a swimmer so as to extend to close to the mouth.

Advantageously the first part comprises a surface which has an aperture suitable for fitting onto a swimming goggles seal and frame.

Advantageously, the breathing aid attachment is made by moulding, and manufactured from a polymer material.

Moreover, the subject of the invention also relates to a breathing aid device for swimming comprising two attachments. Advantageously, both attachments are joined to form a single part by means of a central part used to hold them substantially parallel to each other at a predefined distance. The device may be manufactured in one piece, be assembled during manufacture or be fitted by a user.

Advantageously the two attachments are symmetrically identical, with the symmetry being arranged relative to the sagittal plane. The device is therefore suited to the symmetry of the face and to the breathing symmetry for a swimming stroke wherein swimmers can breathe by turning their heads to the left or to the right in an alternating or other manner. Thus the benefit of the invention is achieved irrespective of the rotation of the head.

Moreover, according to one embodiment, the predefined distance can be adjusted by a suitable adjustment device.

Advantageously the central part is adapted to the shape of the human nose. In other embodiments the central part covers the nose or can form a profiled shell. The central part can also be designed to extend beneath the nose, between the nose and the mouth.

Advantageously, the first part of the first attachment and the first part of the second attachment comprise a common fixing.

Advantageously, when the first part is fixed to the head of a swimmer, the first or second surfaces of each of the two attachments are held pressed in part against the face of the swimmer and extend on either side of the nose near to the mouth. The term "Near to the mouth" should be taken to mean an arrangement in accordance with the following cases:

the device may cover a small portion of the mouth;

the device being arranged between a zero distance and a few centimeters from the lateral limit of the mouth.

Advantageously, the common fixing comprises a third surface suitable for being held pressed against the forehead by a swimming cap.

Advantageously the common fixing comprises an elastic part designed to be passed around the head.

Moreover, the subject of the invention relates to swimming goggles which comprise a breathing aid device for swimming, where the swimming goggles form the central part and the common fixing of the breathing aid device.

Moreover, the subject relates to seals for swimming goggles which act as a breathing aid attachment.

Moreover, the subject of the invention relates to a swimming mask comprising a breathing aid device for swimming. The swimming mask forms the central part and the common fixing for the breathing aid device.

BRIEF DESCRIPTION OF DRAWINGS

Other characteristics and advantages of the invention will emerge on reading the detailed description which follows, with reference to the appended figures, which show:

FIG. 5: a swimmer equipped with swimming goggles comprising a device of the invention, when breathing in;

DESCRIPTION

Figure 1:
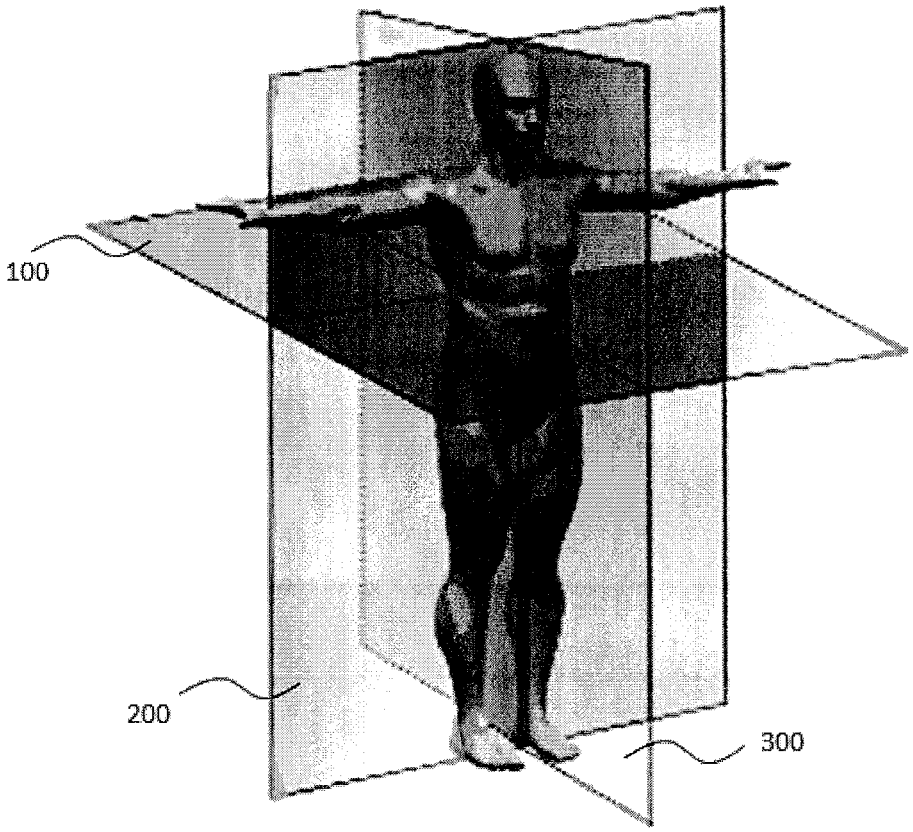
FIG. 1: system of reference indicating the various known planes in the anatomy of the human body.

Reference is made in the following description to the various known planes in the anatomy of the human body shown in FIG. 1, amongst which are: the sagittal plane 300, the transverse plane, 100, the coronal plane 200.

A position wherein the body is held extended, standing or straight and with the head straight and not oriented downwards, upwards or to one side of the body is called a nominal position.

In the following description a breathing aid attachment is interchangeably called a profile or an appendix.

It should be recalled that swimming goggles comprise at least one protective optic, a bridge between two protective optics, seals around optics and at least one optionally adjustable elastic strap.

In the present invention, the term "head" should be taken to mean a set of elements of the human body, amongst which are the top of the head forming the scalp, the nape of the neck, the face comprising the forehead and a part of the neck.

The term "edge" of a surface should be taken to mean: a limit of said surface which joins two extremities of said surface. An edge may be external; in this case it delimits the surface of a material with the exterior between two ends. It can also be internal and in this case it delimits two joined surfaces made of the same material or optionally of different materials.

In the remainder of the description, an attachment is assumed to have one lower extremity closing off the surface and delimiting the latter and the attachment is assumed to have an upper end which is represented by the junction points with the first part comprising a fixing.

In one specific case, the edge may be, for one part, internal and may join two surfaces and for another part may be external and delimit one of the two surfaces with the exterior. This case occurs when one of the two surfaces is longer than the other.

An edge may be straight or slightly curved, depending on the shape of the profiles. When a direction of an edge is referred to in the remainder of the description, then either the mean direction obtained from all the tangents at each point of the limit considered is being referred to, or the direction of the straight line passing through the two ends of the surface.

The invention relates to a breathing aid attachment and/or device which facilitates intake of air and its exhalation with the aim of making it more comfortable for swimmers and which has an effect on swimmers' overall balance and dynamics. The attachment and the device of the invention find a particularly appropriate application in swimming strokes which require side breathing, achieved by a single rotation or alternating bi-rotation of the head and of the body.

The attachment and the device of the invention aim in particular therefore to use and enhance the swimmer's ability to breath in the hollow of the bow wave by channelling streams of water and laminar flow.

Moreover, inhalation and exhalation phases are facilitated whilst promoting the conditions for good hydrodynamic equilibrium, benefiting swimmers' levels of performance and comfort.

The originality of the device of the invention consists of emphasising the limits of the bow-wave trough and in ensuring safe breathing, control over which is essential for the hydrodynamic balance of the stroke, to the benefit of swimmers' performance, their comfort, their endurance and ensuring technical improvement. By providing proprioceptive points of reference, in particular through variations in the pressure of the device on parts of the face, such as the cheekbones, and through differences in pressure of the surroundings at the mouth, the attachment and the device of the invention provide swimmers with improved sensing of the limits of the air and aquatic surroundings and gives them confidence in the presence of this wave. The swimmer's confidence is increased since the attachment of the device returns information which regulates breathing, which corresponds to a vital reflex.

In the appended drawings, given as non-restrictive examples of embodiments of the subject of the invention, the attachment is ideally used in a device which allows two of the invention's attachments to be arranged on the face.

The attachment itself possesses technical characteristics which produce a technical effect, in particular as regards the pressure and negative pressure successively applied on the face during swimming, depending on whether it is non-immersed or immersed. A swimmer who fits one attachment and who swims the crawl whilst always breathing on the same side, or whilst swimming side-stroke, would find a benefit. But it should be understood that for questions of overall balance of the swimmer, symmetry, comfort or for achieving the full benefits of all the technical effects of the solution, the device will preferably use a device comprising two attachments.

The following description primarily describes a device comprising two attachments, joined by a central part without prejudice to the attachment that is the subject of the invention and which shares the same inventive concept.

The breathing aid device comprises at least two attachments.

The two attachments correspond to two hydrodynamic appendices. When the breathing aid device is fixed to the head of a swimmer, with the body and the head in their nominal position, the attachments extend in a direction which is substantially perpendicular to the transverse plane 100.

The use of the device during swimming ensures that the directions of the two attachments generally remain within a cone of 60° relative to the transverse plane at a given instance in time.

Figure 2:
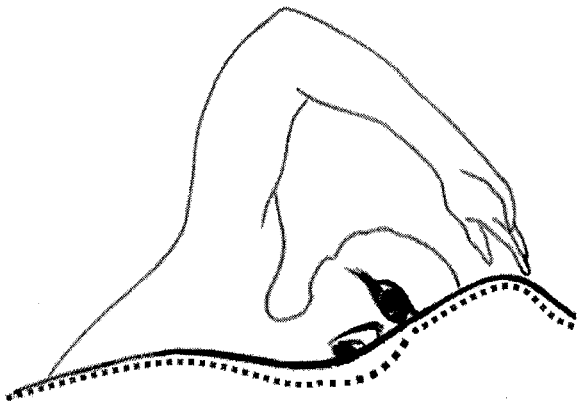
FIG. 2: illustration of a swimmer, swimming the crawl, in the inhalation phase.

FIG. 2 illustrates a crawl swimmer of a good level in mid action. The shape of the bow wave that deforms the surface of the water can be clearly seen marked with a dotted line. The crest of this wave is located in front of the swimmer's forehead with the trough at the neck. The swimmer makes use of this to breath in the trough of the wave at the surface of the water, limiting rotation of the head.

One of the objectives of the device, and/or of the attachment, of the invention is to limit the rotation of the head to the minimum amplitude necessary to allow the swimmer to open their mouth and inhale. One of the advantages of the device of the invention is that when one of the device's attachments is out of the water, the pressure of the water is no longer exerted on the surface of the attachment. Consequently, the swimmer is given information allowing them to know that their mouth is above the water and that they may inhale.

Figure 3:
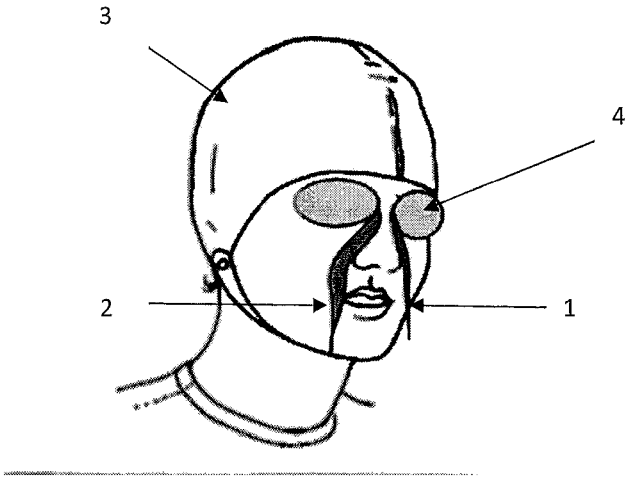
FIG. 3: a schematic diagram of the breathing aid device and its positioning on a human face.

FIG. 3 shows a swimmer wearing a breathing aid device comprising two accessories 1, 2, swimming goggles 4 and a swimming cap 3.

The two hydrodynamic appendices forming the two attachments are placed in a position which is substantially perpendicular to the transverse plane of the body and of the face in the nominal position. The two attachments are located on either side of the mouth and of the nose and are arranged symmetrically in relation to the sagittal plane in the nominal position.

One embodiment allows a planar form which is in an "L" shape and which is concave to be obtained.

One of the advantages of the positioning and holding of the attachments forming two symmetrical profiles on either side of the sagittal plane is to channel the flow over the face whilst facilitating breathing actions.

Figure 4A:
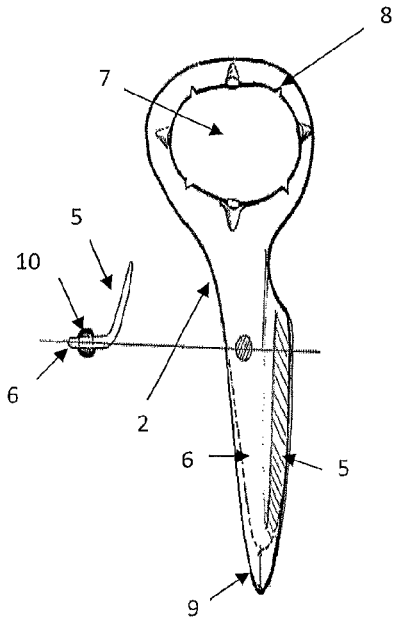
FIG. 4A: an attachment of the invention comprising a fixing suitable for swimming goggles.

FIG. 4A shows one embodiment of an attachment forming a profile 2 suitable for the right-hand side of the face. This profile presents a part 6 intended to rest, in part, on a swimmer's cheekbone, exerting a certain pressure when the attachment is fixed to the head of the swimmer. The profile comprises a second surface 5, which is slightly inclined in relation to the first surface 6. The two surfaces are joined at an axis which forms a natural edge which delimits each of the surfaces 5 and 6. The edge may be in a zone wherein forces are concentrated when an excess pressure is applied onto one of the surfaces of an attachment. It thus forms an amplifier of sensation, insofar as the force exerted on a surface acts on the zone in contact with the skin of the face. The edge located between the two surfaces rests on the skin of the face and allows the differences in pressure applied to the attachment to be enhanced. This pressure difference is thus readily sensed when the swimmer changes the position of their head by rotation, for example, or when the speed is modified, typically when they accelerate or decelerate. Finally the pressure difference is sensed when the head changes its surroundings, for example when the attachment changes from an immersed position to a non-immersed position.

Swimmers can therefore sense the pressure being exerted on a zone of a surface in contact with their skin and particularly at the junction edge. This sensing allows them to assess the position at which they may breathe and allows them to correct poor head positions or ensure fluid movements.

The attachment will preferably be obtained by moulding, for example. A mould adapted to the desired conditions allows alternative forms of the profiles forming the attachment to be obtained. The two surfaces form a single part and are advantageously made from the same material. Other methods of manufacture may be used, such as pressing or bending, in order to achieve the shape of the attachment or of the device when it is manufactured in one piece.

The two surfaces meet at an end 9 of the profile.

By way of an example, the two faces may form two substantially oblique planes which form an angle of between 90° and 180°. Preferably the selected angle will be between 100 and 130°.

The second surface comprises a limit with the exterior which makes up an external edge, directed towards the front of the face. The orientation of the second surface is chosen in such a way that the external edge of the second surface cannot be in contact with the skin of the face. The upper part may optionally touch a part of the nose in certain cases, without this being an aim.

Similarly the first surface may be slightly hollowed so as to exhibit a concave or convex part depending on the reference point in contact with the skin of the face. This last possibility may allow the pressure exerted by the water on the first surface 6 to be enhanced when the face is immersed. This allows the sensation of separation, for example, to be enhanced when the attachment is out of the water. The first mean plane of the second surface is therefore identified.

The second surface may adopt a substantially hollow shape so as to form a wing profile. The second mean plane of the second surface is therefore identified.

The mean planes of the first and second surfaces between them form an angle of between 90° and 180° and preferentially between 100 and 130°.

In another embodiment, the two surfaces joined at the edge form an angle which is variable over the entire length of a part of the common edge. This variable angle remains, at all points of the common edge, between 90° and 180° and preferably between 100 and 130°

The attachment comprises a first part comprising a fixing allowing the attachment to be fixed either to swimming goggles or directly to the head of a swimmer. In both cases, the fixing of the attachment combined with that of the goggles allows the attachment to be fixed to the head of a swimmer.

In the example in FIG. 4A, the fixing 7 of the attachment forms a surface which exhibits an aperture of the ring type, intended to be fitted around goggle seals. This fixing allows ease of combination with swimming goggles, without obstructing the swimmer's vision. In one alternative embodiment the aperture may be open and form a hook which is used to fix the attachment onto a pair of swimming goggles or onto a mask.

In other embodiments, the aperture is suitable for fitting onto the holder, optic or optic protection of the goggles or mask.

The first part is wider relative to the width of the second part forming the profile. The aperture forms an opened-out part which corresponds to the zone opposite the eye of the swimmer. Surface irregularities 8 can allow the attachment 2 to be anchored onto the goggles 4 and to be held in a substantially fixed position from the point of view of the morphology of the face. The attachment in use undergoes small variations of position, in particular relative to the plane of the face. These variations in particular allow swimmers to sense pressure differences applied to the attachment.

The fixing of the goggles comprises an elastic strap which can be placed around the head.

Depending on the embodiments, the elastic may be part of the fixing of the attachment or of the goggles; it may also be a common element of the attachment and swimming goggles assembly.

A section view shows the angle between the two surfaces 5 and 6. The surface 6, intended to be partially placed against the skin of the face, may comprise resting points 10 allowing the sensation of pressure or of negative pressure of the attachment in contact with the skin, when it is immersed in or is out of the water, to be enhanced.

The surface 6 comprises an external edge which may, in one embodiment, be designed to match the shape of the lateral surface of a human nose.

Figure 4B:
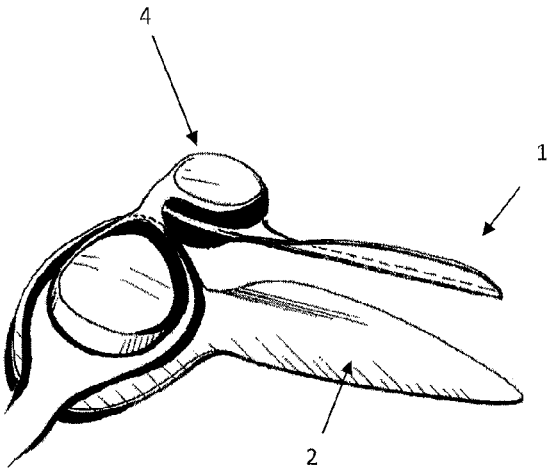
FIG. 4B: two attachments of the invention fixed to swimming goggles.

This profile is designed to be fixed onto a pair of swimming goggles 4, shown in FIG. 4B. The swimming goggles comprise two symmetrical attachments identified as 1 and 2.

Figure 5:
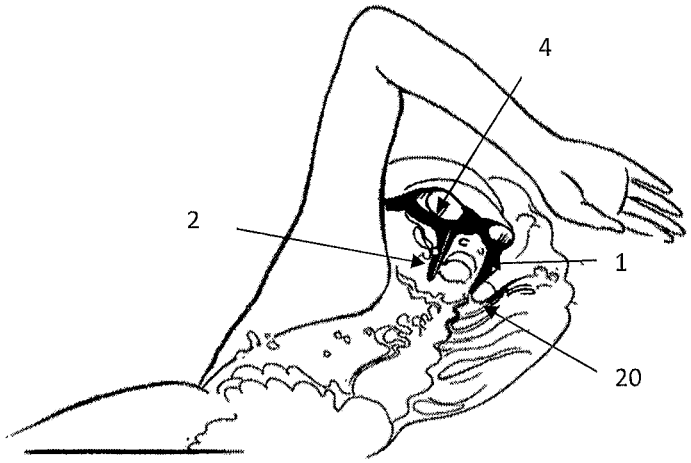

FIG. 5 shows a swimmer, swimming the crawl with a device of the invention comprising two attachments forming two profiles. A swimmer performing the crawl wears swimming goggles 4 forming a single part with profiles 1 and 2. In the inhalation phase in the side position, the surface of the water 20 is channelled by the profile 1 and does not interfere with the swimmer's nose and mouth.

The descriptions of FIGS. 3, 4A and 4B describe an embodiment which is particularly suitable to be fitted into swimming goggles.

The invention relates in addition to swimming goggles which comprise fixed attachments or removable attachments which fit onto swimming goggles. The seal of the goggles may be used to hold an aperture adapted to a surface. This is a simple means of fixing and allows the attachment to be easily separated from the goggles.

FIGS. 6A, 6B, 6C, 6D and 6E show other alternatives of embodiments which do not depend on wearing swimming goggles, but which may be combined with the latter.

In these last embodiments, the two attachments make up a single part, and form, with a central part and means of fixing to a human head, a breathing aid device for swimmers.

FIG. 6 A shows an embodiment wherein the part forming the means of fixing to the head of a swimmer comprises a flat surface designed to be inserted beneath a swimming cap, which exerts a pressure so as to retain the breathing aid device of the invention.

In this embodiment a central part is shaped to rest on the top of the nose. The two accessories extend on either side of the mouth of the swimmer.

Figures 6A, 6B, 6C:
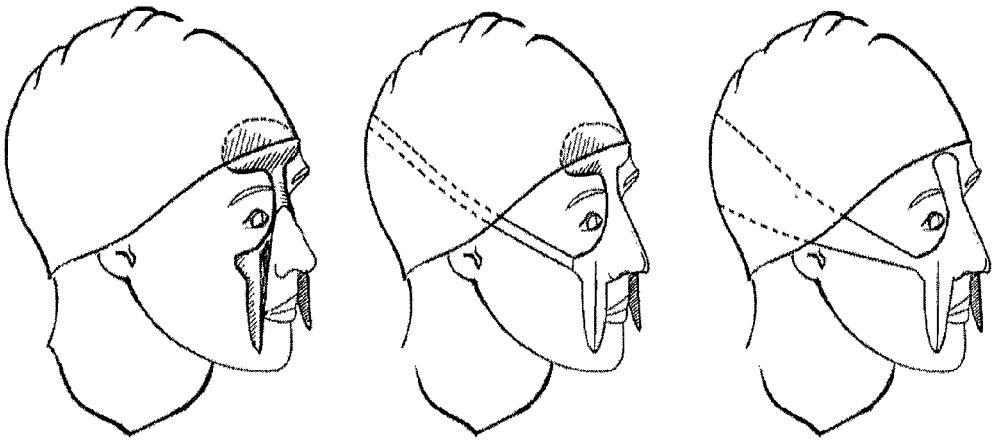
FIG. 6A, 6B, 6C, 6D, 6E: various alternative embodiments of the breathing aid device according to the invention.

FIG. 6B shows an alternative wherein the central part covers a part of the swimmer's nose, thus enhancing the way the device and attachments are held in a substantially fixed position.

FIG. 6B moreover shows a second means allowing the device to be held on the head of the swimmer. This means comprises an elastic strap which passes around the head. This second means of fixing may be combined with the first means of fixing in FIG. 6A which allows the device to be retained beneath the swimming cap.

Thus the various fixing means work together to hold the device on the head of the swimmer.

FIG. 6C is an alternative wherein the elastic fixing is a wide strip to ensure that the device is held correctly on the face of the swimmer.

Figure 6D:
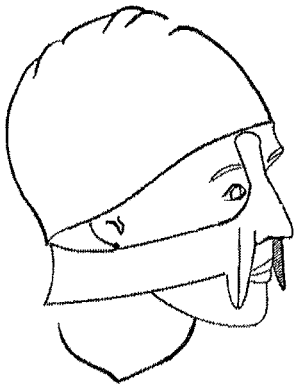

FIG. 6D comprises another alternative embodiment which may also be combined with the other embodiments, wherein the elastic fastening passes is around the neck of the swimmer.

Figure 6E:
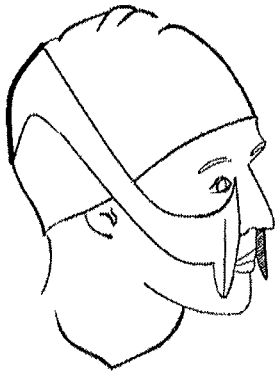

FIG. 6E is an alternative wherein the central part joining the two attachments of the device of the invention is designed to be located behind the head of the swimmer.

The two hydrodynamic appendices shown have an L-shape, whose angle can be selected during the manufacture of the device.

The values of the following parameters are chosen:

- the length and the characteristics of the profile of the first surface;
- the length and the characteristics of the profile of the second surface;
- the profile of the external edge of the first surface;
- the profile of the external edge of the second surface;
- the change in the angles formed between the first and second surface;
- the material of the two surfaces;
- the method of fixing onto the head of the swimmer;
- the weight of the profiles, so as to achieve the best compromise between:

- the comfort of the swimmer, such as ease of breathing actually perceived or the size of the device during breathing achieved through the area of the opening of the mouth, in all positions of the swimmer;
- the hydrodynamic characteristics of the device;
- the desired sensitivity of a first breathing indicator achieved by the differences in pressure applied to each of the surfaces, between the immersed and non-immersed positions, which indicate to the swimmer whether their mouth is immersed or non-immersed;
- the desired sensitivity of a second indicator linked to the fluidity and continuity of the exhalation effort of the swimmer, where the channelling of the exhaled air flowing between the two attachments allows a second indicator to the swimmer, that of the flow of air, to be determined;
- the desired sensitivity of a third indicator linked to the pitching of the face and therefore of the body through the differences in pressures felt on the first surfaces resting against the face;
- the desired sensitivity of a fourth indicator linked to the roll of the face and therefore of the body of the swimmer during the swimming stroke, obtained from the difference in pressures perceived between the two second surfaces of the device;
- the desired sensitivity of a fifth indicator corresponding to the yawing motion of the face and therefore of the body of the swimmer during the swimming stroke, obtained from the difference in pressures perceived between the two second surfaces of the device.

The improvement in breathing in the trough of the bow wave through the use of a technical device, together with the positioning of its constituent elements, provides the subject of the invention with the maximum technical effects for improving the swimmer's breathing and guidance.

For example, the device also channels water streams or drops falling from the forehead and therefore prevents these entering the respiratory tract during inhalation.

Furthermore, as detailed above, when the face is fully immersed, the device channels the flow at the surface of the face and contributes to the creation and stabilisation of a negative pressure at the mouth and nose; thus the device contributes to a reduction in the hydrodynamic pressure exerted on the respiratory tract during exhalation.

The flow of water over the main body of the hydrodynamic element increases the pressure exerted by the liquid surroundings on said hydrodynamic element. The faster the swimmer moves, the greater the pressure associated with the increase in flow. Different versions of the device may be made, as indicated earlier, in order to be suitable for use by an adult or by a child, or by a is beginner or by an experienced swimmer. Thus versions of the device of the invention can be produced according to the different profiles of swimmers, including by age, size, experience in performing the crawl, or for specific face shapes.

Advantageously, the device can include, in all embodiment alternatives, means for adjusting the separation of the two attachments or for increasing its size, for example by a telescopic system allowing the length of the surface areas of the attachments to be adjusted.

According to one preferred embodiment, it is proposed that the two hydrodynamic appendices have an L-shape form and that they are fixed in a removable manner by being fitted into the water-tight seal of the optical swimming attachment as shown in FIGS. 4A and 4B.

According to one alternative the device may be held by means of the elastic grip from the swimming cap as described above.

According to other alternatives, it may be the extension of at least one part of an attachment which covers and grips at least a part of the skull or of the neck.

The dimensional characteristics of the hydrodynamic appendices are correlated with the dimensions of the face and with the programme for use. The length is between 2 cm and 20 cm from the line of the eyes, depending on the use and on the swimmers.

A length of profile chosen from within the interval of 6 to 12 cm gives a good compromise between feeling comfortable and aid with breathing, whilst limiting undesirable drag effects.

One embodiment alternative which also relates to a method of manufacture of profiles, proposes pre-cut or pre-detached profiles so as to facilitate, in particular, the production of the latter. One advantage is to offer adaptability of the profiles to the particular needs of the swimmer.

These hydrodynamic appendices can take a number of 2D and 3D forms. They may be formed by being cut out of a flat plate, by sculpture or by moulding and plastic or composite injection.

Advantageously, the profiles can offer an embossed texture or be fitted with protuberances 10, strips or slots to enhance the stability on the face and the transfer of sensations.

Advantageously, the device of the invention provides swimmers with indications during the four breathing steps already identified above. For example, the exhalation step is improved by the fact that the swimmer senses the flow of air along the profiles and can sense the regularity of their exhalation effort. Another example is that of offering an indicator to swimmers when they lift their heads out of the water, the first surface, assumed to be that which is pressed against the face, is no longer subject to the same pressure out of the water. Under these conditions, the swimmer does not need to turn the head more than is necessary in order to inhale air. The muscular effort for rotating the head is therefore optimised and the pitching of the head and therefore of the body is reduced, and a more fluid stroke is achieved, The device allows the hydrodynamic profile to be improved, facilitates swimmers' breathing (inhalation-exhalation), and amplifies sensory perceptions of hydrodynamic imbalance. These effects allow swimmers to correct errors in movements or of speed during the stroke and contribute to swimmers learning the best breathing positions.

During periods of swimming with the face under water-exhalation and of transition to the inhalation position, the device improves the hydrodynamic profile of the nose and creates a negative pressure, facilitating exhalation of air, bubbles of which are to a certain degree directed by the device, thus promoting a more hydrodynamic laminar flow.

During the four intervals, the device amplifies the hydrodynamic pressure-negative pressure phenomenon, thus helping swimmers perceive poor positions and poor yawing, roll and pitching movements of the body. Actions to return to the proper position are therefore improved by these indicators. Swimmers are helped to achieve a better perception of the relationship between correct position and sensory perception.

Developing a good breathing technique is therefore one of the greatest challenges for beginner and intermediate swimmers, and improvement of this technique also remains a daily task for the best swimmers. The device of the invention has the advantage of not only allowing beginners to learn well, but also of allowing more experienced swimmers to improve.

Finally the junction zone of the two surfaces located at the bottom end of the device may be round or pointed. The profile of the junction may be selected so as to limit drag effect during the crawl stroke for a swimmer who has a given profile.

The profiles are preferentially made from a rigid material. The material is preferentially a polymer, that is an elastomer or a thermosetting or thermoplastic polymer.

Profiles can also be made from rubber or from composites.

When the breathing device is made in one piece, obtained for example by moulding, it may be made of a single material as defined above. This is also true for elements of swimming goggles or masks, such as the optics, seals comprising a device of the invention which would be obtained by manufacture from a single piece.

The breathing aid attachment of the invention is an aid for nose- and/or mouth-breathing. In particular it improves the alternation of nose-breathing and helps give it rhythm. It is important that the attachment does not restrict nasal respiration by preventing air flowing into the nose when the head is out of the water. The attachment also acts as the fastest possible indicator to is swimmers that they may breather, through a change of the sensation of contact with their faces. In order not to prevent nose-breathing, the attachment must not exert too great a pressure on the nose. Contact is preferentially made alongside the nose and lightly on the slope of the nose and on the cheek, up to the nasolabial folds, and extends into a zone close to the labial commissures of the mouth, or even to up to them.

The attachment is preferentially arranged on this area of the face, that is, alongside the nose and next to the mouth, since it is known to be one of the most sensitive areas of the face. In effect, the forehead area is very insensitive; it is outside the wave formation caused by the forward movement of the arms and of the head in the water.

The breathing aid attachment of the invention comprises a free end. One of the ends of the attachment is deliberately not fixed, so as to allow latitude of movement which can range up to separation, depending on the embodiments chosen. The rotation and inclination movements of the head in liquid or air surroundings therefore produce a different pressure of the attachment on the contact zones defined above, thus forming a sensory indicator.

The breathing aid attachment of the invention is suitable for fixing on any type of goggles. In particular the shape of the aperture may be adapted to match the perimeter of a seal of a swimming goggles lens.

Figure 7:
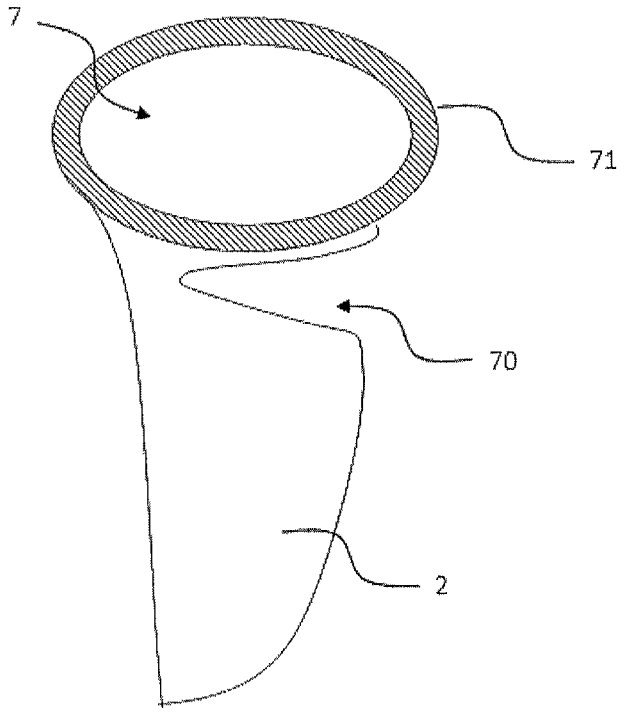
FIG. 7: an embodiment of the breathing aid attachment comprising a cut-out.

FIG. 7 shows an embodiment wherein the breathing aid attachment of the invention comprises a cut-out 70 between the profile 2 and the aperture 7. The profile 2 may form one piece with the edge 71 forming an aperture 7. An advantage of the cut-away is to allow better flexibility of the profile which is fully or partly in contact with a portion of the swimmer's face. As a result of this improved flexibility, the attachment can transfer the pressure differentials that occur during the change of position or surroundings much more accurately to the skin. Moreover, this improved flexibility reduces carry-over and mechanical is concentration effects on the goggles or their seals, thus minimising or preventing the goggles from lifting or causing discomfort. The cut-away is preferentially aligned substantially along a mean axis which is perpendicular to the mean axis along which the profile extends towards the bottom of the face.

According to another alternative that is not shown, the cut-away may be replaced by a second aperture. The second aperture is then preferentially located in the upper part of the profile, that is, close to the first aperture, allowing the attachment to be fixed to swimming goggles.

These embodiments, wherein one cut-away or one aperture may be introduced are compatible with all the embodiment alternatives described above, such as alternatives with a mask or with the attachment manufactured directly as part of the goggles seal etc.

The invention claimed is:

1. A breathing aid attachment for swimming, comprising at least one first part comprising a device to fix the attachment and a second part comprising a first substantially flat surface, the first part being designed to hold a first zone of the first surface of the second part in contact with the skin of a swimmer's face so as to create a sensory indicator generated by differences in pressure applied on the first zone.

2. The breathing aid attachment for swimming according to claim 1, wherein the device to fix the attachment allows the attachment to be fixed onto the head of a swimmer.

3. The breathing aid attachment for swimming according to claim 1, wherein the device to fix the attachment allows the attachment to be fixed onto swimming goggles.

4. The breathing aid attachment for swimming according to claim 1, wherein the differences in pressure are generated by a change in the position of the head of the swimmer, a change in the movement of the head of the swimmer or a change in the surroundings of the device between aquatic surroundings and air surroundings.

5. The breathing aid attachment for swimming according to claim 1, wherein the first surface comprises a first edge, designed, when the attachment is fixed to the head of a swimmer, to extend along a direction which forms an angle of less than 60° with the normal to the transverse plane, at least one part of the first edge being comprised within said zone.

6. The breathing aid attachment for swimming according to claim 5, wherein the first edge is designed to be substantially perpendicular to the transverse plane when the swimmer is in a nominal position.

7. The breathing aid attachment for swimming according to claim 5, wherein the first edge has a length of between 2 and 20 cm.

8. The breathing aid attachment for swimming according to claim 5, wherein the second part comprises a second surface joined to the first surface by at least one part of the first edge, the first and the second surfaces forming an angle of between 90° and 180° at least one point at their junction.

9. The breathing attachment for swimming according to claim 1, wherein when the first part is fixed to the head of a swimmer, the first part allows the first zone of the first surface of the second part to be held against the face of a swimmer so as to extend to close to the mouth.

10. The breathing aid attachment for swimming according to claim 1, wherein the first part comprises a surface which has an aperture suitable for fitting onto a swimming goggles seal.

11. The breathing aid attachment for swimming according to claim 1, wherein the breathing aid attachment is made by moulding and manufactured from a polymer material.

12. A breathing aid device for swimming comprising two attachments according to claim 1, wherein the two attachments are formed into a single part using a central part allowing them to be held substantially parallel to each other at a predefined distance.

13. The breathing aid device for swimming according to claim 12, wherein the two attachments are designed to be symmetrically identical, the symmetry being achieved in relation to the sagittal plane.

14. The breathing aid device for swimming comprising two attachments according to claim 12, wherein a distance between the two attachments can be adjusted by a suitable adjustment device.

15. The breathing aid device for swimming according to claim 12, wherein the central part is adapted to a shape of a human nose.

16. The breathing aid device for swimming according to claim 12, wherein the first part of the first attachment and the first part of the second attachment comprise a common fixing.

17. The breathing aid device for swimming according to claim 12, wherein when the first part is fixed to the head of a swimmer, the first zones of each of the two attachments are held resting against the face of the swimmer and extend on either side of the nose.

18. The breathing aid device for swimming according to claim 16, wherein the common fixing comprises a third surface suitable for being held against the forehead by the pressure of a swimming cap.

19. The breathing aid device for swimming according to claim 16, wherein the common fixing comprises an elastic part intended to pass around the head.

20. Swimming goggles comprising a breathing aid device for swimming according to claim 16, the swimming goggles forming the central part and the common fixing of the breathing aid device.

21. The swimming goggles according to claim 20, wherein seals of the goggles form the attachments.

22. A swimming mask comprising a breathing aid device for swimming according to claim 16, the swimming mask forming the central part and the common fixing of the breathing aid device.

23. The breathing aid device for swimming according to 1, wherein the device to fix the attachment is a flat surface designed to be inserted beneath a swimming cap.

24. The breathing aid device for swimming according to 1, wherein the device to fix the attachment is an elastic strap to pass around the head of the swimmer.

25. A seal for swimming goggles or mask, wherein the seal comprises a breathing aid attachment for swimming, comprising at least one first part comprising a device to fix the attachment and a second part comprising a first substantially flat surface, the first part being designed to hold a first zone of the first surface of the second part in contact with the skin of a swimmer's face so as to create a sensory indicator generated by differences in pressure applied on the first zone.

* * * * *